United States Patent [19]

Silverberg et al.

[11] Patent Number: 4,630,920

[45] Date of Patent: Dec. 23, 1986

[54] BLADE CLEANING APPARATUS FOR REMOVING RESIDUAL TONER FROM A CHARGE RETENTIVE SURFACE

[75] Inventors: Mort Silverberg, Rochester; Richard G. Maus, Macedon; Nero R. Lindblad, Ontario, all of N.Y.

[73] Assignee: Xerox Corporation, Stamford, Conn.

[21] Appl. No.: 773,288

[22] Filed: Sep. 6, 1985

[51] Int. Cl.[4] ..... G03G 15/08

[52] U.S. Cl. ..... 355/15; 355/3 BE; 355/3 DD; 430/125

[58] Field of Search ..... 355/15, 3 BE, 16, 3 R; 430/125

[56] References Cited

U.S. PATENT DOCUMENTS 3,838,472 10/1974 Oriel ..... 355/15 X
4,314,756 2/1982 Amitani et al. ..... 355/15
4,357,098 11/1982 Endo ..... 355/15

*Primary Examiner*—A. C. Prescott

[57] ABSTRACT

Highly efficient, long life blade cleaning apparatus for removing residual toner particles from a flexible photoreceptor supported for movement in an endless path. The cleaning blade is supported for pressure engagement with a flexible belt such that the belt is deflected. A backing member is supported in contact with the reverse side of the belt for controlling the degree of belt deflection and thereby the force required by the blade for efficient cleaning to a minimum and effect substantially uniform contact between the blade and the charge retentive member. The support is positioned downstream of the blade a predetermined distance which minimizes the required cleaning force and also allows the belt to twist to thereby conform to the blade edge resulting in substantially uniform contact between the blade and belt.

47 Claims, 2 Drawing Figures

BLADE CLEANING APPARATUS FOR REMOVING RESIDUAL TONER FROM A CHARGE RETENTIVE SURFACE

BACKGROUND OF THE INVENTION

This invention relates to an electrophotographic printing machine, and more particularly concerns an improved cleaning system for use therein.

In electrophotographic printing, a charge retentive surface such as a photoconductive member is charged to a uniform potential. The uniformly charged photoconductive member is exposed to a light image of an original document being reproduced. Exposure of the sensitized photoconductive surface discharges the charge selectively. This records an electrostatic latent image on the photoconductive surface corresponding to the informational areas contained within the original document being reproduced.

It should be understood that for the purposes of the present invention, which relates to the removal of residual toner particles from a charge retentive surface subsequent to image transfer, the latent electrostatic image may be formed by means other than by the exposure of an electrostatically charged photosensitive member to a light image of an original document. For example, the latent electrostatic image may be generated from information electronically stored or generated in digital form which may afterwards be converted to alphanumeric images by image generation electronics and optics. For example, the latent image can be formed electronically by using a modulated laser used in connection with a suitable scanning device. However, such image generation electronic and optic devices form no part of the present invention.

Development of the electrostatic latent image recorded on the photoconductive surface is achieved by presenting developer material to the latent image. Typical developer materials comprise a heat settable plastic powder, known in the art as toner particles. The toner particles are selected to have the appropriate charge relative to the electrostatic latent image recorded on the photoconductive surface so that they are electrostatically attracted to the latent image.

After development of the latent image to render it visible, the powder images are transferred to a copy substrate such as plain paper.

Frequently, residual toner particles remain adhering to the photoconductive surface after transfer from the photoconductive surface to the substrate material. Heretofore, cleaning devices such as webs, brushes or foam rollers, have not been entirely satisfactory in removing residual toner particles from the photoconductive surface in all instances.

One of the more attractive methods for removing residual toner particles from the photoconductive surface has been to use a rotating magnet enclosed in a stationary, non-magnetic shell or, alternatively, to utilize stationary magnets enclosed within a rotating, non-magnetic shell. This system attracts carrier granules which, in turn, attract the residual toner particles from the photoconductive surface thereto. However, cleaning systems of this type are presently rather costly and complex in order to achieve the desired cleaning efficiency.

Another of the more attractive methods of removing residual toner particles from a charge retentive surface is to use a blade to either wipe and/or chisel the residual toner from the surface.

Cleaning blade structures are commercially used for removing residual toner from drum-type photoreceptors used in machines that have a relatively slow (i.e., a small number of copies produced in a given time period) process speed. However, their use in the higher speed machines and in conjunction with belt-type photoreceptors has not met with great success.

Previous blade cleaning has employed urethane blades with edges capable of conforming to surface of the photoreceptor drum. The problems with such an arrangement include excessive blade wear, (particularly at higher operating speeds) need for lubricant, blade tucking and toner powder clouding. Low contact pressure solves the problem of blade wear but results in inefficient cleaning.

In view of the foregoing, it can be seen that a highly efficient, long life blade cleaning apparatus for removing residual toner from a photoreceptor surface is desirable.

SUMMARY OF THE INVENTION

In accordance with the features of the present invention, there is provided a highly efficient, relatively low cost and long life blade cleaning apparatus for removing residual toner particles from a flexible charge retentive member such as a photoconductive belt.

Earlier attempts to utilize a cleaning blade with a flexible charge retentive belt member over a support roll resulted in unsatisfactory cleaning. Increasing the normal force between the blade and belt to improve cleaning caused unacceptable blade wear. We discovered an acceptable solution to the problem by positioning the blade over an unsupported section of the belt, preferably with a resilient backing or support member contacting the opposite side of the belt. We discovered that by positioning this backing member a predetermined distance downstream from the line of contact between the blade edge and the belt resulted in efficient cleaning at much lower contact pressures than thought possible.

The support serves to limit the deflection of the belt and provide for a more uniform force, along the edge of the cleaning blade and the flexible belt. The deflection of the belt limited by the support member allows it to conform to the cleaning blade edge thereby effecting substantially uniform contact between the blade edge and the belt, the degree of conformability being controlled by the aforementioned spacing of the support from the location of the blade.

In carrying out our invention, there is provided a cleaning blade and means for effecting pressure engagement between it and the flexible charge retentive surface such that the belt is deflected. A preferably resilient backing member in the form of a stationarily mounted blade member contacts the side of the charge retentive member opposite the one contacted by the cleaning blade.

The backing member serves to control the degree of deflection of the belt and thereby the force between the blade and the belt. By properly positioning (i.e., downstream of the blade) of the support member and selection of the spacing or offset between the blade and the support we discovered that efficient cleaning could be accomplished with forces that did not cause excessive wear of the belt.

By spacing the belt from the support the belt is free to twist and thereby conform to the blade edge resulting in substantially uniform contact therebetween. We found that the required force of the blade on the belt varies with the spacing between the blade and the support and that by spacing the support at a predetermined distance from the blade a minimum force was required.

Various techniques have hereinbefore been employed to clean photoconductive surfaces. The following disclosures appear to be relevant to the present invention:

U.S. Pat. No. 3,706,108, issued to Taylor on Dec. 19, 1972.

U.S. Pat. No. 4,501,486, issued to Landa on Feb. 26, 1985.

U.S. Pat. No. 4,428,665, issued to Hays on Jan. 31, 1984.

U.S. Pat. No. 3,640,617, issued to Fredrickson et al on Feb. 8, 1972.

U.S. Pat. No. 4,527,887, issued to Vineski on Aug. 29, 1983.

The pertinent portions of the foregoing disclosues may be briefly summarized as follows:

Taylor discloses a rotary cleaning brush used to sweep or knock loose the toner particles from a photoconductive surface of a belt. In the specification the fibers of the brush are referred to as blades. The brush is electrically biased so that the blades electrostatically attract toner particles from the belt surface.

Landa is directed to a blade for cleaning toner from a liquid developed imaging surface. The blade comprises a body of high conductivity formed of rubber impregnated with carbon particles and a tip contacting the imaging surface formed of an inherently conductive rubber of lesser conductivity. The liquid developer affects the conductivity of the body but not that of the tip and the tip is replaceably inserted in a cooperating reentrant cavity of large surface area formed in the body to provide a low contact resistance therebetween. The blade is electrically biased to improve its attraction of the developer.

Hays is directed to a process and an improved apparatus for simultaneously removing and transporting undesirable residual insulating toner particles from a flexible imaging member comprising in operative relationship, a cleaning roll containing on its surface insulating carrier particles, the cleaning roll being charged to a predetermined potential, a deflected flexible imaging member containing residual insulating toner particles thereon, a cleaning zone encompassed by and situated between said cleaning roll and the deflected flexible imaging member, a magnet contained in the cleaning roll, and magnetic strips contained in the outer periphery of said cleaning roll means. In operation the flexible imaging member is deflected into an arc, causing the formation of a cleaning zone encompassed by the cleaning roll and the flexible member.

Fredrickson et al disclose a photoconductive sheet having a latent image thereon which is passed through a receptacle containing liquid developer. Excess liquid toner is removed from the sheet by a doctor blade.

Vineski discloses a blade cleaner for removing residual toner from a charge retentive belt. Vineski discloses a deflected belt in connection with a cleaning device. As viewed in FIG. 2, a shield 82 exerts a force on the belt to cause the aftermentioned deflection.

DETAILED DESCRIPTION OF THE DRAWINGS

Figure 1:
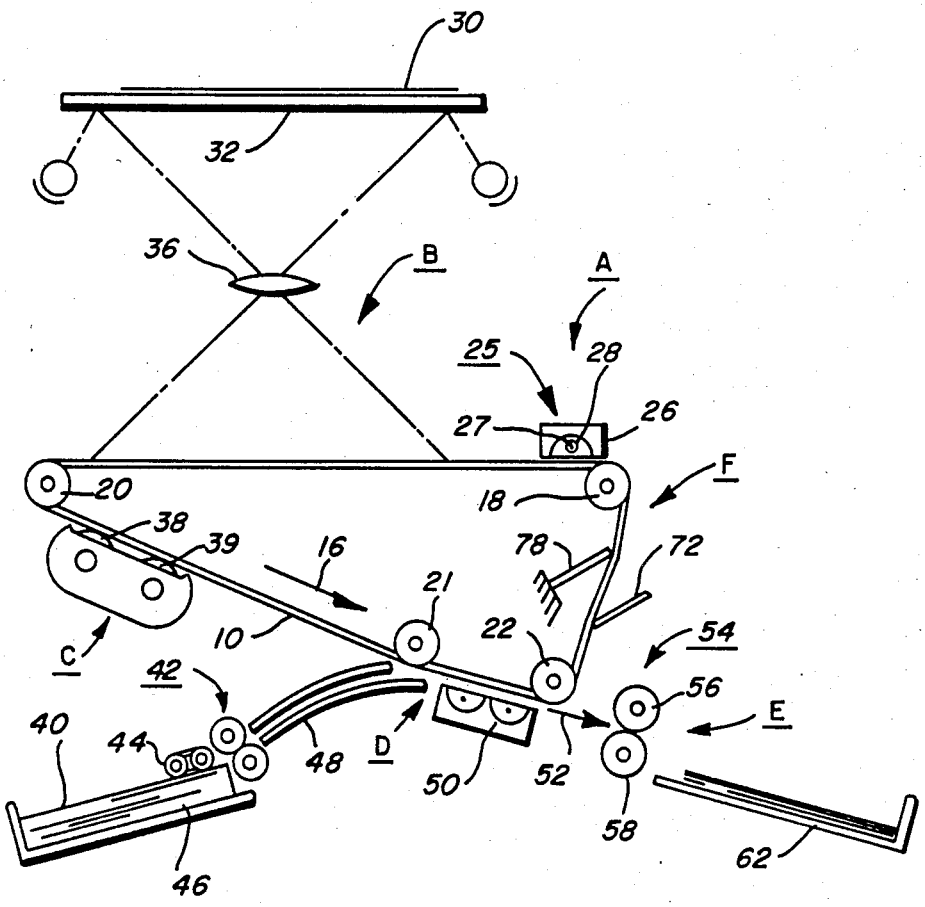
Figure 2:
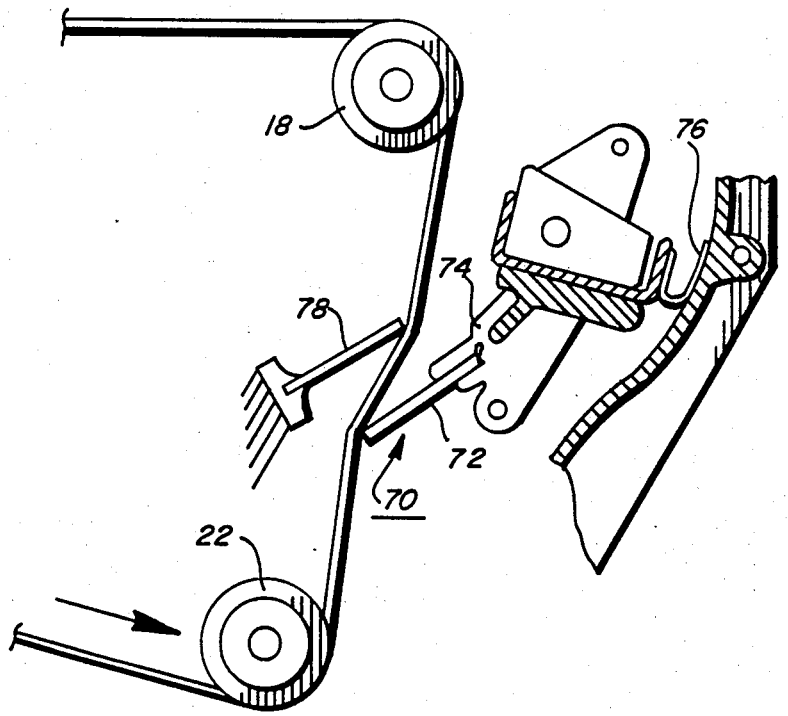

Other aspects of the present invention will become apparent as the following description proceeds with upon reference to the drawings, in which:

FIG. 1 is a schematic elevational view depicting an electrophotographic printing machine incorporating the features of the present invention therein; and FIG. 2 is a schematic elevational view illustrating the cleaning system of the FIG. 1 printing machine.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of the illustrative electrophotographic printing machine incorporating the features of the present invention, reference is made to the drawings. In the drawings, like reference numerals have been used throughout to designate identical elements.

DETAILED DESCRIPTION OF THE PREFERRED EMBODIMENT OF THE INVENTION

Inasmuch as the art of electrophotographic printing is well known, the various processing stations employed in the printing machine illustrated in FIG. 1 will be described only briefly.

As shown in FIG. 1, the printing machine utilizes a charge retentive member preferably in the form of a flexible photoconductive belt 10 which consists of an electrically conductive substrate, a charge generator layer comprising photoconductive particles randomly dispersed in an electrically insulating organic resin and a charge transport layer comprising a transparent electrically inactive polycarbonate resin having dissolved therein one or more diamines. A photoconductive belt of the foregoing type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof.

Belt 10 is entrained about stripping roller 18, tension roller 20 and drive roller 22. Roller 22 is coupled to motor 24 by suitable means such as a drive chain. Belt 10 is maintained in tension by a pair of springs (not shown) which resiliently urge tension roller 20 against belt 20 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device indicated generally by reference numeral 25 charges the charge generating layer of belt 10 to a relatively high, substantially uniform negative potential.

A suitable corona generating device for negatively charging the photoconductive belt 10 comprises a conductive shield 26 and corona wire 27, the latter of which is coated with an electrically insulating layer 28 having a thickness which precludes a net dc corona current when an A.C. voltage is applied to the corona wire when the shield and photoconductive surface are at the same potential.

Next, the charged portion of the photoconductive belt is advanced through exposure station B. At exposure station B, an original document 30 is positioned face down upon a transparent platen 32. The light rays reflected from original document 30 form images which are transmitted through lens 36. The light images are projected onto the charged portion of the photoconductive belt to selectively dissipate the charge thereon. This records a latent electrostatic image on the belt which corresponds to the informational area contained within original document 30.

Thereafter, belt 10 advances the electrostatic latent image to development station C. At development station C, magnetic brush developer rollers 38 and 39 disposed in a developer housing or sump 41 advance developer into contact with the electrostatic latent image. The latent image attracts the developer particles from the developer rollers or rolls thereby forming visible images on the photoconductive belt. The developer rolls 38 and 39 may comprise any conventional construction known in the art of printing.

Belt 10 then advances the toner powder image to transfer station D. At transfer station D, a sheet of support material such as plain paper 40 is moved into contact with the toner powder images. The sheet of support material is advanced to transfer station D by a sheet feeding apparatus 42. Preferably, sheet feeding apparatus 42 includes a feed roll structure 44 contacting the upper sheet of stack 46. Feed roll 44 rotates so as to advance the upper most sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona generating structure 50 which sprays ions of a suitable polarity onto the backside of sheet 40 so that the toner powder images are attracted from photoconductive belt 10 to sheet 40. After transfer, the sheet continues to move in the direction of arrow 52 onto a conveyor (not shown) which advances the sheet to fusing station E.

Fusing station E includes a fuser assembly, indicated generally by the reference numeral 54, which permanently affixes the transferred toner powder images to sheet 40. Preferably, fuser assembly 54 includes a heated fuser roller 56 adapted to be pressure engaged with a back-up roller 58 with the toner powder images contacting fuser roller 56. In this manner, the toner powder images are permanently affixed to sheet 40. After fusing, sheets 40 are received in a catch tray 62 for removal from the printing machine by the operator.

At the cleaning station F, residual toner and contaminants or debris such as paper fibers and Kaolin are removed from the photoreceptor surface by means of a blade structure 70. Structure 70 comprises a blade 72 and blade holder 74. The blade holder is spring biased by means of a spring element 76 to thereby urge the blade 72 into pressure engagement with the belt 10. The blade may be fabricated from any suitable material such as metal or plastic or it may be fabricated from an elastomer. The preferred material is urethane.

A backing or support member 78 is stationarily supported in contact with the opposite side of the belt from the side contacted by the blade 72. The support member limits the deflection of the belt 10 and thereby controls the force created between the blade and the belt. The spring element 76 and the support member 78 cooperate to generate a force of about 25 gm./cm. when the support is positioned approximately 4–6 millimeters downstream of the blade. By downstream is meant that a given area on the belt first contacts the blade and then the support. The support member 78 is preferably fabricated from a resilient material.

The blade may be disposed at any angle relative to the belt which does not cause planing of the blade on the belt or blade rollover, flip or chatter.

The support member 78 may be in the form of a blade, roller or flat plate. The material from which the support member is fabricated may be metal, plastic or rubber.

As will be appreciated, there has been shown and described a blade cleaning apparatus which efficienty removes residual toner from a flexible charge retentitive surface and which due to the relatively low loading force required will function for a longer period of time then heretofore thought possible.

This blade cleaning apparatus is also suitable for use in relatively high speed printng machines (i.e. machines having a process speed of 20 in./sec.).

We claim:

1. Blade cleaning apparatus for removing residual toner particles from a flexible charge retentive member supported for movement in an endless path, said apparatus comprising:

a cleaning blade supported for contact with the imaging side of said charge retentive member;

means for effecting pressure engagement between said blade and belt whereby said belt is deflected; and a backing member supported in contact with the opposite side of said charge retentive member from said imaging side for controlling the deflection of said flexible belt whereby the force required for efficient cleaning by the cleaning blade is minimized and there is substantially uniform contact between the blade and the charge retentive member.

2. Apparatus according to claim 1 wherein contact between said blade and said belt is continuous.

3. Apparatus according to claim 1 wherein said belt and said blade make subtantially line contact therebetween.

4. Apparatus according to claim 3 wherein contact between said blade and said belt is continuous during a cleaning cycle.

5. Apparatus according to claim 2 wherein said cleaning blade is fabricated from an elastomeric material.

6. Apparatus according to claim 5 wherein said backing member comprises a blade member.

7. Apparatus according to claim 2 wherein said cleaning blade comprises a rigid member.

8. Apparatus according to claim 4 wherein said cleaning blade is fabricated from an elastomeric material.

9. Apparatus according to claim 8 wherein said backing member comprises a blade member.

10. Apparatus according to claim 9 wherein toner removal is effected by a chiselling action of said cleaning blade.

11. Apparatus according to claim 9 wherein toner removal is effected by a wiping action of said cleaning blade.

12. Apparatus according to claim 1 wherein said support member is positioned within 4–6 millimeters of the line of contact between said cleaning blade and said flexible belt.

13. Apparatus according to claim 1 wherein said flexible charge retentive member comprises a belt.

14. Apparatus according to claim 13 wherein said charge retentive member comprises a photoreceptor.

15. Apparatus according to claim 14 wherein contact between said blade and said belt is continuous.

16. Apparatus according to claim 15 wherein said belt and said blade make subtantially line contact therebetween.

17. Apparatus according to claim 16 wherein said cleaning blade is fabricated from an elastomeric material.

18. Apparatus according to claim 17 wherein said backing member comprises a blade member.

19. Apparatus according to claim 15 wherein said cleaning blade comprises a rigid member.

20. Apparatus according to claim 19 wherein toner removal is effected by a chiselling action of said cleaning blade.

21. Apparatus according to claim 19 wherein toner removal is effected by a wiping action of said cleaning blade.

22. Apparatus according to claim 19 wherein said support member is positioned within 4–6 millimeters of the line of contact between said cleaning blade and said flexible belt.

23. Apparatus according to claim 22 wherein said support member is positioned within 4–6 millimeters of the line of contact between said cleaning blade and said flexible belt.

24. Method of removing residual toner from a flexible charge retentive member, said method comprising the steps of:

contacting the imaging surface of said charge retentive member with a cleaning blade with sufficient pressure to cause deflection thereof; and contacting the reverse surface of said charge retentive member from said imaging surface with backing member for controlling the deflection of said flexible belt whereby the force required for efficient cleaning by the cleaning blade is minimized and there is substantially uniform contact between the blade and the charge retentive member.

25. Method according to claim 24 wherein contact between said blade and said belt is continuous.

26. Method according to claim 24 wherein said belt and said blade make subtantially line contact therebetween.

27. Method according to claim 26 wherein contact between said blade and said belt is continuous during a cleaning cycle.

28. Method according to claim 25 wherein said cleaning blade is fabricated from an elastomeric material.

29. Method according to claim 28 wherein said backing member comprises a blade member.

30. Method according to claim 25 wherein said cleaning blade comprises a rigid member.

31. Method according to claim 27 wherein said cleaning blade is fabricated from an elastomeric material.

32. Method according to claim 31 wherein said backing member comprises a blade member.

33. Method according to claim 32 wherein toner removal is effected by a chiselling action of said cleaning blade.

34. Method according to claim 32 wherein toner removal is effected by a wiping action of said cleaning blade.

35. Method according to claim 24 wherein said support member is positioned within 4–6 millimeters of the line of contact between said cleaning blade and said flexible belt.

36. Method according to claim 24 wherein said flexible charge retentive member comprises a belt.

37. Method according to claim 36 wherein said charge retentive member comprises a photoreceptor.

38. Method according to claim 37 wherein contact between said blade and said belt is continuous.

39. Method according to claim 38 wherein said belt and said blade make subtantially line contact therebetween.

40. Method according to claim 39 wherein said cleaning blade is fabricated from an elastomeric material.

41. Method according to claim 40 wherein said backing member comprises a blade member.

42. Method according to claim 38 wherein said cleaning blade comprises a rigid member.

43. Method according to claim 42 wherein toner removal is effected by a chiselling action of said cleaning blade.

44. Method according to claim 42 wherein toner removal is effected by a wiping action of said cleaning blade.

45. Method according to claim 42 wherein said support member is positioned within 4–6 millimeters of the line of contact between said cleaning blade and said flexible belt.

46. Apparatus according to claim 1 wherein said support member contacts said belt downstream of the position of contact between said belt and said blade.

47. Apparatus according to claim 1 wherein said blade and said support member contact said belt at a predetermined distance from each other, said distance being such as to create a force between said belt and said blade of approximately 25 gm./cm.

* * * * *